US007950900B2

(12) United States Patent
Mulcaire et al.

(10) Patent No.: US 7,950,900 B2
(45) Date of Patent: May 31, 2011

(54) AEROFOIL STAGE AND SEAL FOR USE THEREIN

(75) Inventors: Thomas Mulcaire, Derby (GB); Samantha Gormley, Chesterfield (GB)

(73) Assignee: Rolls-Royce PLC, London (GB)

( * ) Notice: Subject to any disclaimer, the term of this patent is extended or adjusted under 35 U.S.C. 154(b) by 1054 days.

(21) Appl. No.: 11/798,252

(22) Filed: May 11, 2007

(65) Prior Publication Data

US 2007/0280830 A1 Dec. 6, 2007

(30) Foreign Application Priority Data

Jun. 6, 2006 (GB) ..... 0611031.6

(51) Int. Cl.
*F01D 9/04* (2006.01)
*F01D 5/22* (2006.01)

(52) U.S. Cl. ..... 415/208.2; 415/191; 416/191; 416/193 R; 416/193 A; 416/196 R

(58) Field of Classification Search ..... 416/190, 416/191, 193 A, 194, 195, 196 R, 193 R; 415/191, 208.2, 210.1, 211.2, 209.3, 209.4
See application file for complete search history.

(56) References Cited

U.S. PATENT DOCUMENTS

| | | | | |
|---|---|---|---|---|
| 5,890,874 | A | 4/1999 | Lambert et al. | |
| 6,217,283 | B1 * | 4/2001 | Ravenhall et al. | 416/193 A |
| 6,634,863 | B1 | 10/2003 | Forrester et al. | |

FOREIGN PATENT DOCUMENTS

| | | | |
|---|---|---|---|
| EP | 0 787 890 | A2 | 8/1997 |
| EP | 0 874 132 | A3 | 10/1998 |
| EP | 1 013 886 | A3 | 6/2000 |
| EP | 1 067 274 | A1 | 1/2001 |
| EP | 1 635 037 | A2 | 3/2006 |
| JP | 9-4410 | | 1/1997 |
| WO | WO 93/22539 | A1 | 11/1993 |

* cited by examiner

*Primary Examiner* — Christopher Verdier
(74) *Attorney, Agent, or Firm* — Oliff & Berridge, PLC

(57) ABSTRACT

A stage for a gas turbine engine, having a plurality of circumferentially spaced apart radially extending aerofoils, includes a plurality of annulus fillers to bridge the spaces between adjacent aerofoils to define an inner wall of a flow annulus through the stage. Each annulus filler has opposing side faces which are spaced circumferentially from the adjacent blades and which correspond in profile therewith, and resilient seal strips each including a stiffener are mounted adjacent the opposing side faces of the annulus fillers to seal the gaps between the annulus fillers and the aerofoils. The stiffeners have three-dimensional curvature.

36 Claims, 3 Drawing Sheets

AEROFOIL STAGE AND SEAL FOR USE THEREIN

This invention relates to gas turbine engines. More specifically, it relates to seals for bridging gaps between adjacent aerofoils in rotor or stator stages of gas turbine engines. The invention is particularly suited to seals for annulus fillers in a fan stage of an engine, but it may equally well be applied in other parts of the engine.

Conventionally a fan rotor stage in a gas turbine engine comprises a plurality of radially extending fan blades mounted on a disc. The blades are mounted on the disc by inserting the inner end of the blade in a correspondingly shaped retention groove in the outer face of the disc periphery. Annulus fillers bridge the spaces between adjacent blades to define the inner wall of an annular gas passage in which the fan rotor stage is located in use.

It is known to provide a seal between the annulus fillers and the adjacent fan blades by providing resilient strips bonded to the annulus fillers adjacent the fan blades. The strips protrude so that they abut the adjacent fan blades and seal the gaps. This prevents air leaking past the inner wall of the annular gas passage.

The gaps vary throughout the flight cycle as the fan blades undergo tangential, radial and axial movements caused by gas, thermal and centrifugal loadings, and the annulus fillers move radially under the influence of centrifugal loading.

A large number of seal designs are known, including solid rubber seals, bellows seals, brush seals, compressible tube seals and composite seals with a rubber tip. These have various disadvantages. For example, solid rubber seals are heavy, the rubber tips of the composite seals are prone to debonding, and bellows seals are prone to severe erosion because the bellows sits close to the airstream. All these types of seal, though, share the particular disadvantage that they can only span relatively small gaps and accommodate relatively small movements between the fan blades and the annulus fillers.

With increasing fan diameter comes a larger range of movement of the blades, especially pronounced with the swept fan blades increasingly favoured for their superior aerodynamic performance, and necessarily the gaps between the fan blades and the annulus fillers is larger. In such fans, conventional seals cannot maintain a satisfactory seal over the whole operating envelope of the engine.

If gaps open up between the seal and the blade, grit or other foreign matter may be trapped between the seal and the blade, resulting in scratching of the blade surface which may render it unserviceable.

It is an aim of this invention to provide a seal for a rotor or stator stage in a gas turbine that alleviates the aforementioned problems.

According to a first aspect of the invention, a stage for a gas turbine engine comprises a plurality of circumferentially spaced apart radially extending aerofoils, a plurality of annulus fillers being provided to bridge the spaces between adjacent aerofoils to define an inner wall of a flow annulus through the stage, each annulus filler having opposing side faces which are spaced circumferentially from the adjacent aerofoils and which correspond in profile therewith, resilient seal strips each including a stiffener being mounted adjacent the opposing side faces of the annulus fillers, characterised in that the stiffener has three-dimensional curvature. Preferably, the stiffener has curvature in the radial, axial and tangential directions.

Each annulus filler may bridge a space between a suction surface of one aerofoil and a pressure surface of an adjacent aerofoil, and the seal strip adjacent the suction surface may be stiffer than the seal strip adjacent the pressure surface. Alternatively, the seal strip adjacent the pressure surface may be stiffer than the seal strip adjacent the suction surface.

Each seal strip may be mounted adjacent the respective side face of the annulus filler so as to define an angle between the seal strip and the respective side face, and the angle for at least one seal strip may vary along the length of that seal strip.

Each seal strip may be mounted adjacent the respective side face of the annulus filler so as to define a circumferential offset between the seal strip and the respective side face, and the offset for at least one seal strip may vary along the length of that seal strip. Preferably, the offset is at a minimum adjacent the leading edge of the aerofoils and is at a maximum adjacent the trailing edge of the aerofoils.

The depth of at least one stiffener may vary along the length of its associated seal strip. The depth may vary such that the distances from the bottom of the seal strip to the bottom of the stiffener, and from the top of the stiffener to the top of the seal strip, are constant along the length of the seal strip.

The seal strips may be adhesively mounted adjacent the opposing side faces of the annulus fillers. Preferably, the radial and tangential distances between the stiffeners and their respective side faces are optimised to minimise the stress in the adhesive joints.

Each stiffener may be coated in resilient material only on the side adjacent its respective aerofoil. Alternatively, each stiffener may be completely embedded in resilient material. The resilient material may be rubber.

The stiffener may be manufactured as an integral part of a composite seal strip. The seal strips may be manufactured as an integral part of a composite component.

The aerofoils may be stator vanes, or they may be rotor blades.

A second aspect of the invention provides an annulus filler for bridging in use the space between two adjacent aerofoils of a gas turbine engine to define an inner wall of a flow annulus through the stage, each annulus filler having opposing side faces, resilient seal strips each including a stiffener being mounted adjacent the opposing side faces of the annulus fillers, characterised in that the stiffener has three-dimensional curvature. Preferably, the stiffener has curvature in the radial, axial and tangential directions.

Each annulus filler may in use bridge a space between a suction surface of one aerofoil and a pressure surface of an adjacent aerofoil, and the seal strip adjacent the suction surface may be stiffer than the seal strip adjacent the pressure surface. Alternatively, the seal strip adjacent the pressure surface may be stiffer than the seal strip adjacent the suction surface.

Each seal strip may be mounted adjacent the respective side face of the annulus filler so as to define an angle between the seal strip and the respective side face, and the angle for at least one seal strip may vary along the length of that seal strip.

Each seal strip may be mounted adjacent the respective side face of the annulus filler so as to define a circumferential offset between the seal strip and the respective side face, and the offset for at least one seal strip may vary along the length of that seal strip. Preferably, the offset is at a minimum adjacent the leading edge of the aerofoils and is at a maximum adjacent the trailing edge of the aerofoils.

The depth of at least one stiffener may vary along the length of its associated seal strip. The depth may vary such that the distances from the bottom of the seal strip to the bottom of the stiffener, and from the top of the stiffener to the top of the seal strip, are constant along the length of the seal strip.

The seal strips may be adhesively mounted adjacent the opposing side faces of the annulus filler. Preferably, the radial and tangential distances between the stiffeners and their respective side faces are optimised to minimise the stress in the adhesive joints.

Each stiffener may be completely embedded in resilient material. The resilient material may be rubber.

The stiffener may be manufactured as an integral part of a composite seal strip. The seal strips may be manufactured as an integral part of a composite component.

According to a third aspect of the invention, a seal strip for an annulus filler of a gas turbine engine includes a stiffener, characterised in that the stiffener has three-dimensional curvature. Preferably, the stiffener has curvature in the radial, axial and tangential directions.

The seal strip may in use be mounted adjacent a side face of an annulus filler so as to define an angle between the seal strip and the side face, and the angle may vary along the length of the seal strip.

The seal strip may in use be mounted adjacent a side face of an annulus filler so as to define a circumferential offset between the seal strip and the side face, and the offset may vary along the length of the seal strip.

The depth of the stiffener may vary along the length of the seal strip. The depth may vary such that the distances from the bottom of the seal strip to the bottom of the stiffener, and from the top of the stiffener to the top of the seal strip, are constant along the length of the seal strip.

In use, the seal strip may be adhesively mounted adjacent a side face of an annulus filler. Preferably, the radial and tangential distances between the stiffener and the side face are optimised to minimise the stress in the adhesive joint.

The stiffener may be completely embedded in resilient material. The resilient material may be rubber.

The stiffener may be manufactured as an integral part of a composite seal strip.

The invention will now be described, by way of example, with reference to the accompanying drawings in which.

Figure 1:
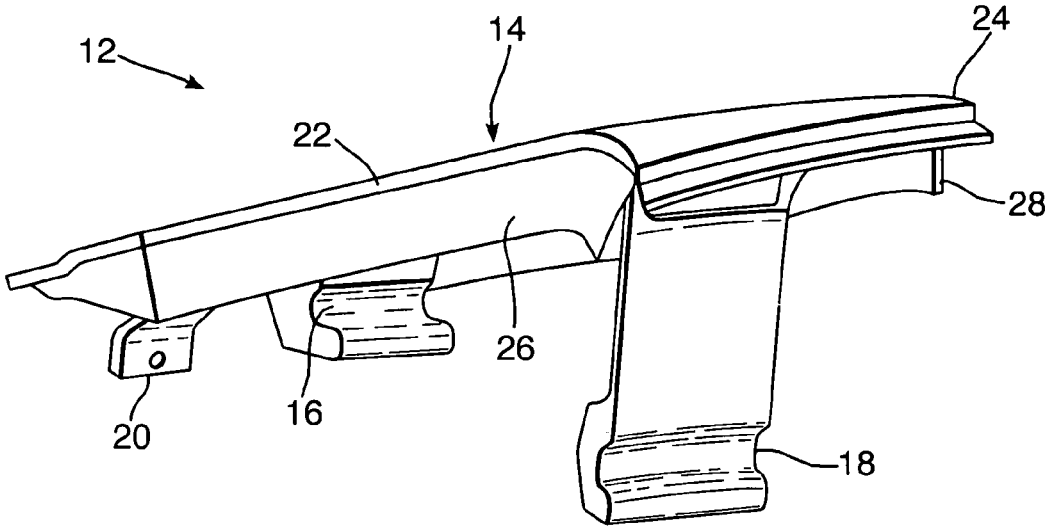
FIG. 1 is a perspective view of an annulus filler for a stage according to the invention.

Referring first to FIG. 1, an annulus filler of known type is shown generally at 12. In use, the upper surface 14 or lid of the annulus filler 12 bridges the gap between two adjacent fan blades and defines the inner wall of the flow annulus of the fan stage. The annulus filler 12 is mounted on a fan disc (not shown) by two hooks 16 and 18, respectively towards the forward and rearward ends of the annulus filler 12. It is also attached to the support ring (not shown) by a mounting feature 20.

The annulus filler 12 has two opposed side faces 22, 24, which in use confront the aerofoil surfaces of two adjacent fan blades (not shown). The side face 22 confronts the suction surface of one fan blade, and the side face 24 confronts the pressure surface of the adjacent fan blade. Mounted adjacent the side face 22 is a suction side seal strip 26, which extends generally outwards and downwards from the side face 22 (in use, these directions correspond respectively to circumferentially and radially inwards). A pressure side seal strip 28 is similarly mounted adjacent the side face 24.

Figure 2:
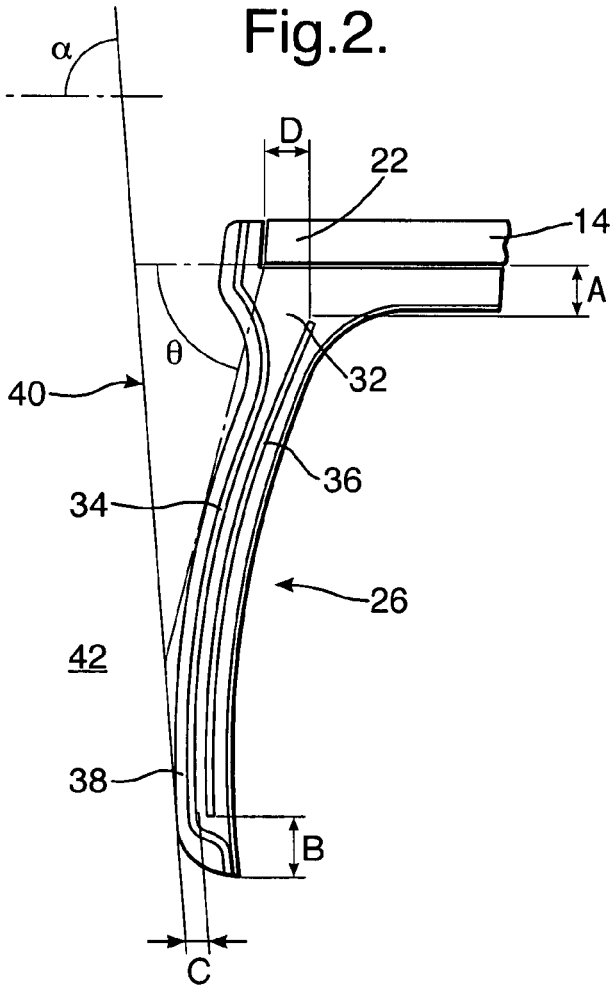
FIG. 2 is an axial view of a seal strip for a stage according to the invention, showing details of its construction.

FIG. 2 shows the construction of the seal strip 26 in more detail. The construction of seal strip 28 is essentially identical.

The seal strip 26 is adhesively mounted on the underside of the annulus filler lid 14, adjacent the side face 22. The body 32 of the seal strip 26 is formed of rubber, with a cloth reinforcing layer 34. The seal strip 26 also includes a metal stiffener 36, which extends substantially the full axial length of the seal strip 26 (in this figure, "axial" is the direction into and out of the paper). The flap 38 defines an angle θ with the annulus filler lid 14.

The reinforcing layer 34 extends through the whole radial depth of the seal strip 26. The stiffener 36, however, does not. Dimension A indicates the distance from the top of the stiffener 36 to the top of the seal strip 26. Dimension B indicates the distance from the bottom of the seal strip 26 to the bottom of the stiffener 36. The radial depth of the stiffener 36 varies along its length to ensure that the dimensions A and B remain constant, so that the stiffener cannot break through the rubber body 32 during manufacture.

In use, the flap 38 of the seal strip 26 contacts the suction surface 40 of a fan blade 42. Centrifugal forces arising from the rotation of the fan stage urge the seal strip 26 into contact with the surface 40, so that a close seal is maintained. The dimension D indicates the circumferential distance between the side face 22 and the top of the stiffener 36. The dimensions A and D are optimised to provide sufficient flexibility in the flap 38, while minimising the stresses in the adhesive joint between the seal strip 26 and the annulus filler. The dimensions A and D are also important to ensure that the stiffener 36 cannot migrate past the side face 22 and "knife" itself outwards, resulting in the loss of the seal. This "knifing" can occur if the stiffener is not supported sufficiently firmly. The centrifugal forces cause the stiffener to be forced outwards, and it may cut through the rubber and be released.

Dimension C shows the thickness of the rubber overlying the stiffener adjacent the aerofoil surface. This thickness must be sufficient to prevent the stiffener from breaking through and scratching the aerofoil surface.

Large diameter, swept fan blades have a steep blade angle α from mid-chord rearwards to the trailing edge of the blade. If the seal strip presents the same angle to the blade surface along its whole length, there is a risk that part of the seal strip may become jammed against the blade during a run-down in speed, or conversely may "flip" through the gap between the annulus filler and the blade during a run-up in speed.

Figure 3:
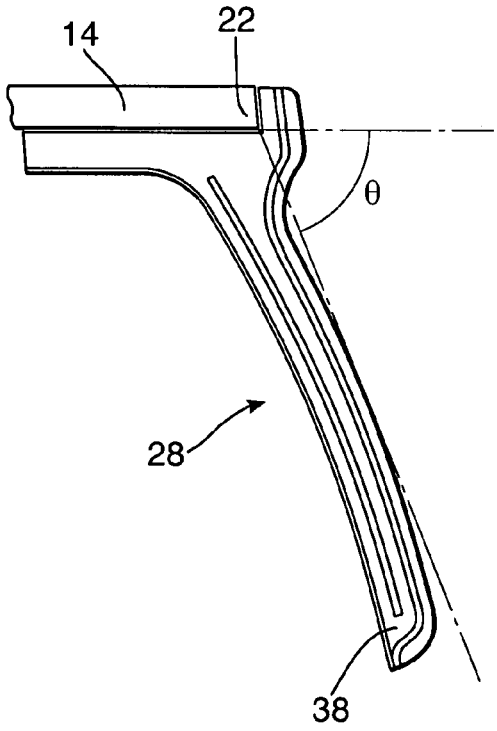
FIGS. 3 and 4 are axial views of a seal strip for a stage according to the invention, showing the variation in angle along the length of the seal.
Figure 4:
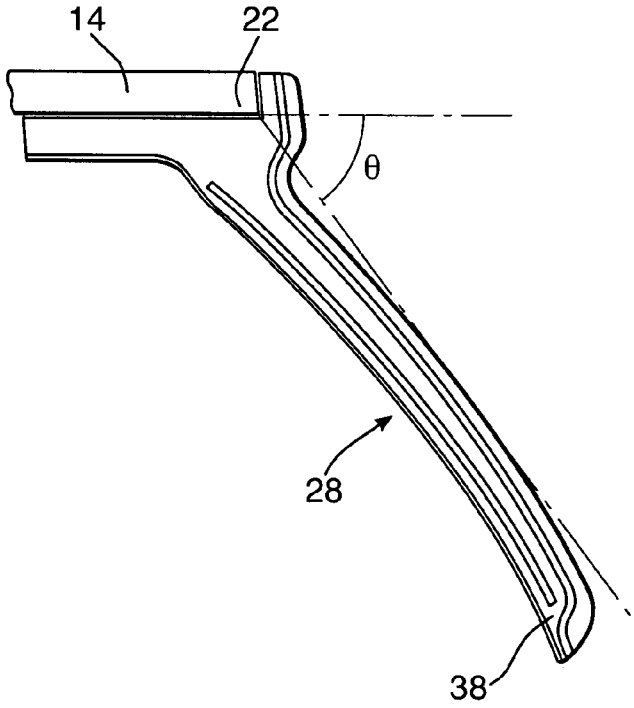

To prevent this, the angle θ varies along the length of the seal strip, as illustrated by FIG. 3 (approximately at mid-chord) and FIG. 4 (close to the trailing edge). This varying shape allows the seal to conform to the fan blade shape during build and during all running conditions, ensuring a good sealing between the blade and the seal and also ensuring that the filler is built centrally between the fan blades. By varying the angle the size of the channel between the seal and the fan blade is minimised, thus maximising the aerodynamic efficiency of the assembly.

Figure 5:
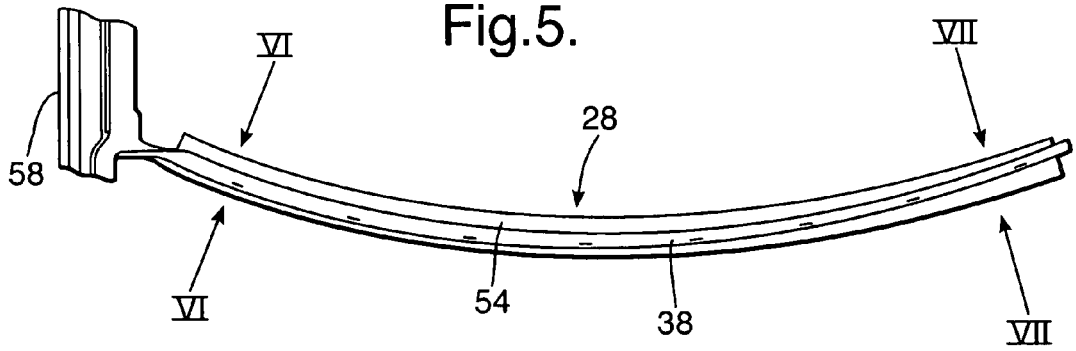
FIG. 5 is a plan view of a seal strip for a stage according to the invention.
Figure 6:
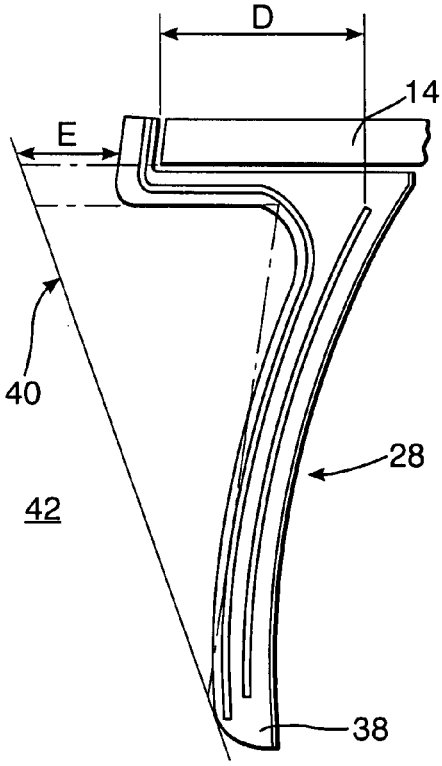
FIGS. 6 and 7 are cross-sectional views of FIG. 5, taken respectively at the positions marked VI-VI and VII-VII.
Figure 7:
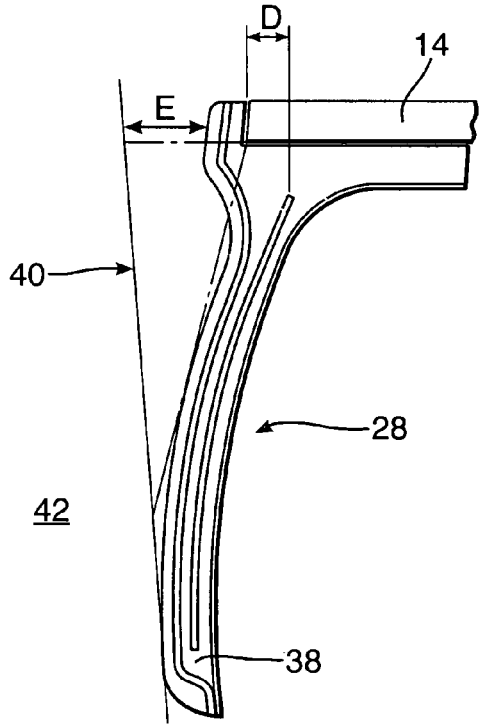

Also, in contrast to known seals, the position of the seal strip relative to the side face varies along the length of the seal strip. This is shown in FIGS. 5, 6 and 7. In FIG. 5, the bonding platform 54 is bonded in use to the annulus filler lid 14. The flap 38 of the seal strip projects from the bonding platform 54. An additional seal portion 58 is bonded in use beneath the leading edge of the annulus filler lid 14, and provides a seal between the annulus filler 12 and the spinner fairing (not shown). The varying position of the flap 38 relative to the bonding platform 54 is clearly visible in FIG. 5. The arrows VI-VI and VII-VII indicate the positions of the cross-sectional views of FIGS. 6 and 7, which show this variation in more detail.

The dimension D is relatively large towards the forward end of the seal strip 26 (FIG. 6), and relatively small towards its rearward end (FIG. 7). This arrangement has the further advantage that the gap E between the side face 22 of the annulus filler 12 and the surface 40 of the adjacent blade 42 is substantially constant, and relatively small. A large gap E would increase the risk of misalignment of the annulus filler 12 on assembly.

By tuning the relative stiffness of the pressure and suction side seals, the seals can be used to guide the filler into position between the fan blades during build, and to ensure that it locates in the correct position between the two blades. In this embodiment, the stiffness of the suction side seal strip 26 is designed to be slightly higher than the stiffness of the pressure side seal strip 28.

It will be appreciated that various modifications are possible to the embodiment described in this specification, without departing from the spirit and scope of the claimed invention.

For example, the seal strip 26 may be mounted on the annulus filler 12 by mechanical fasteners or by any other convenient method.

The body 32 of the seal strip 26 may be formed of any suitable resilient material. To suit certain manufacturing methods, the stiffener 36 may be coated on one side only with resilient material, instead of being embedded in it.

The seal strips may be formed in composite material, incorporating an integral stiffener. The seal strip may form an integral part of a larger composite component.

The stiffener 36 may be formed of a suitable non-metallic material. It may be formed in a single piece, or in several segments along the length of the seal strip 26. Although the invention is particularly suited to use in annulus fillers of fan stages, it could equally well be applied to any other application in which a varying gap has to be sealed. Such applications may include others in which the components are subjected to centrifugal loads, but may also include non-rotating structures such as the fan outlet guide vane stage of a gas turbine engine, in which the gaps between stationary vanes are bridged by infill panels which define the inner wall of a flow annulus.

We claim:

1. A stage for a gas turbine engine comprising:

a plurality of circumferentially spaced apart radially extending aerofoils, and a plurality of annulus fillers that bridge the spaces between adjacent aerofoils to define an inner wall of a flow annulus through the stage, each annulus filler having opposite side faces which are spaced circumferentially from the adjacent aerofoils and which correspond in profile therewith, and resilient seal strips each including a stiffener mounted adjacent the opposite side faces of the annulus fillers, wherein:

the stiffener has a three-dimensional curvature, each annulus filler bridges a space between a suction surface of one aerofoil and a pressure surface of an adjacent aerofoil, and the seal strip adjacent the suction surface is stiffer than the seal strip adjacent the pressure surface, or the seal strip adjacent the pressure surface is stiffer than the seal strip adjacent the suction surface.

2. The stage as in claim 1, wherein the stiffener has a curvature in the radial, axial and tangential directions.

3. The stage as in claim 1, wherein:

each seal strip is mounted adjacent the respective side face of the annulus filler so as to define an angle between the seal strip and the respective side face, and the angle for at least one seal strip varies along the length of that seal strip.

4. The stage as in claim 1, wherein:

each seal strip is mounted adjacent the respective side face of the annulus filler so as to define a circumferential offset between the seal strip and the respective side face, and the offset for at least one seal strip varies along the length of that seal strip.

5. The stage as in claim 4, wherein the offset is at a minimum adjacent the leading edge of the aerofoils and is at a maximum adjacent the trailing edge of the aerofoils.

6. The stage as in claim 1, wherein the depth of at least one stiffener varies along the length of its associated seal strip.

7. The stage as in claim 6, wherein the depth varies such that the distances from the bottom of the seal strip to the bottom of the stiffener, and from the top of the stiffener to the top of the seal strip, are constant along the length of the seal strip.

8. The stage as in claim 1, wherein each stiffener is coated in resilient material only on the side adjacent its respective aerofoil.

9. The stage as in claim 8, wherein the resilient material is rubber.

10. The stage as in claim 1, wherein each stiffener is completely embedded in resilient material.

11. The stage as in claim 1, wherein the stiffener is manufactured as an integral part of a composite seal strip.

12. The stage as in claim 1, wherein the seal strips are manufactured as an integral part of a composite component.

13. The stage as in claim 1, wherein the aerofoils are stator vanes.

14. The stage as in claim 1, wherein the aerofoils are rotor blades.

15. A stage for a gas turbine engine comprising:

a plurality of circumferentially spaced apart radially extending aerofoils, and a plurality of annulus fillers that bridge spaces between adjacent aerofoils to define an inner wall of a flow annulus through the stage, each annulus filler having opposite side faces which are spaced circumferentially from the adjacent aerofoils and which correspond in profile therewith, and resilient seal strips each including a stiffener mounted adjacent the opposite side faces of the annulus fillers, wherein:

the stiffener has a three-dimensional curvature, the seal strips are adhesively mounted adjacent the opposite side faces of the annulus fillers, and the radial and tangential distances between the stiffeners and their respective side faces have been optimised to minimise the stress in the adhesive joints.

16. An annulus filler for bridging in use space between two adjacent aerofoils of a gas turbine engine to define part of an inner wall of a flow annulus through a stage of the engine, the annulus filler comprising:

opposite side faces, and resilient seal strips each including a stiffener being mounted adjacent the opposite side faces of the annulus filler, wherein:

the stiffener has a three-dimensional curvature, the annulus filler bridges a space between a suction surface of one aerofoil and a pressure surface of an adjacent aerofoil, and the seal strip adjacent the suction surface in use is stiffer than the seal strip adjacent the pressure surface in use or the seal strip adjacent the pressure surface in use is stiffer than the seal strip adjacent the suction surface in use.

17. The annulus filler as in claim 16, wherein the stiffener has a curvature in the radial, axial and tangential directions.

18. The annulus filler as in claim 16, wherein:

each seal strip is mounted adjacent the respective side face of the annulus filler so as to define an angle between the seal strip and the respective side face, and the angle for at least one seal strip varies along the length of that seal strip.

19. The annulus filler as in claim 16, wherein:

each seal strip is mounted adjacent the respective side face of the annulus filler so as to define a circumferential offset between the seal strip and the respective side face, and the offset for at least one seal strip varies along the length of that seal strip.

20. The annulus filler as in claim 19, wherein in use the offset is at a minimum adjacent the leading edge of the aerofoils and is at a maximum adjacent the trailing edge of the aerofoils.

21. The annulus filler as in claim 16, wherein the depth of at least one stiffener varies along the length of its associated seal strip.

22. The annulus filler as in claim 21, wherein the depth varies such that the distances from the bottom of the seal strip to the bottom of the stiffener, and from the top of the stiffener to the top of the seal strip, are constant along the length of the seal strip.

23. The annulus filler as in claim 16, wherein each stiffener is completely embedded in resilient material.

24. The annulus filler as in claim 23, wherein the resilient material is rubber.

25. The annulus filler as in claim 19, wherein the stiffener is manufactured as an integral part of a composite seal strip.

26. The annulus filler as in claim 16, in which the seal strips are manufactured as an integral part of a composite component.

27. An annulus filler for bridging in use space between two adjacent aerofoils of a gas turbine engine to define part of an inner wall of a flow annulus through a stage of the engine, the annulus filler comprising:

opposite side faces, and resilient seal strips each including a stiffener being mounted adjacent the opposite side faces of the annulus filler, wherein:

the stiffener has a three-dimensional curvature, the seal strips are adhesively mounted adjacent the opposite side faces of the annulus filler, and the radial and tangential distances between the stiffeners and their respective side faces have been optimised to minimise the stress in the adhesive joints.

28. A seal strip for an annulus filler of a gas turbine engine, the seal strip including a stiffener, wherein:

the stiffener has a three-dimensional curvature, in use the seal strip is adhesively mounted adjacent a side face of the annulus filler, and the radial and tangential distances between the stiffener and the side face have been optimised to minimise the stress in the adhesive joint.

29. The seal strip as in claim 28, wherein the stiffener has a curvature in the radial, axial and tangential directions.

30. The seal strip as in claim 28, wherein:

in use it is mounted adjacent the side face of the annulus filler so as to define an angle between the seal strip and the side face, and the angle varies along the length of the seal strip.

31. The seal strip as in claim 28, wherein:

in use it is mounted adjacent the side face of the annulus filler so as to define a circumferential offset between the seal strip and the side face, and offset varies along the length of the seal strip.

32. The seal strip as in claim 28, wherein the depth of the stiffener varies along the length of the seal strip.

33. The seal strip as in claim 32, wherein the depth varies such that the distances from the bottom of the seal strip to the bottom of the stiffener, and from the top of the stiffener to the top of the seal strip, are constant along the length of the seal strip.

34. The seal strip as in claim 28, wherein the stiffener is completely embedded in resilient material.

35. The seal strip as in claim 34, wherein the resilient material is rubber.

36. The seal strip as in claim 28, wherein the stiffener is manufactured as an integral part of a composite seal strip.

* * * * *